US007113105B2

(12) United States Patent
Sahm et al.

(10) Patent No.: US 7,113,105 B2
(45) Date of Patent: Sep. 26, 2006

(54) WORK MACHINE DISPLAY SYSTEM

(75) Inventors: William Charles Sahm, Dunlap, IL (US); Craig Lawrence Koehrsen, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 509 days.

(21) Appl. No.: 10/653,353

(22) Filed: Aug. 28, 2003

(65) Prior Publication Data

US 2005/0046599 A1 Mar. 3, 2005

(51) Int. Cl.
*G08B 21/00* (2006.01)

(52) U.S. Cl. ..... 340/679; 172/4.5; 340/438; 701/50

(58) Field of Classification Search ..... 340/425.5, 340/988, 995.1, 438, 679, 684, 685; 414/694; 701/50, 300; 172/4.5, 811, 430
See application file for complete search history.

(56) References Cited

U.S. PATENT DOCUMENTS 4,807,131 A * 2/1989 Clegg ..... 701/50
5,854,988 A * 12/1998 Davidson et al. ..... 701/50
5,964,298 A 10/1999 Greenspun ..... 701/50
5,996,702 A * 12/1999 Hall ..... 172/4.5
6,047,227 A * 4/2000 Henderson et al. ..... 701/50
6,363,632 B1 * 4/2002 Stentz et al. ..... 37/414
6,453,227 B1 9/2002 Kalafut et al. ..... 172/4.5
6,736,216 B1 * 5/2004 Savard et al. ..... 172/1

* cited by examiner

*Primary Examiner*—Brent A. Swarthout
(74) *Attorney, Agent, or Firm*—Finnegan, Henderson, Farabow, Garrett & Dunner

(57) ABSTRACT

A display system and method for a work machine is provided. A terrain map indicative of a current surface configuration for a geographic location is displayed. The display of the terrain map includes a plurality of elevation segments. Each of the plurality of elevation segments has an actual surface elevation value for a discrete area of the geographic location. A position of a ground engaging tool operatively connected to the work machine is monitored. A current elevation of the ground engaging tool is identified. The display of the elevation segment corresponding to the location of the ground engaging tool is updated when the current elevation of the ground engaging tool indicates a change in the actual surface elevation value for the elevation segment corresponding to the location of the ground engaging tool.

21 Claims, 4 Drawing Sheets

WORK MACHINE DISPLAY SYSTEM

TECHNICAL FIELD

The present invention is directed to a display system and, more particularly, to a display system for a work machine.

BACKGROUND

Work machines are commonly used to excavate earth or other material from a geographic location such as, for example, a construction site. A work machine typically includes a ground engaging tool, such as, for example, a bucket or shovel to remove earth or material from the surface of the geographic location. A work machine operator may control the movement of the ground engaging tool to excavate earth or other material from the geographic location to shape the surface to conform to a desired surface configuration.

The ground engaging tool of a work machine may be powered by a hydraulic system. A typical hydraulic system includes a series of hydraulic actuators, which may be, for example, hydraulic cylinders, that are interconnected with a work implement linkage that mounts the ground engaging tool. The hydraulic system may also include a series of control valves that govern the rate and direction of fluid flow into and out of each hydraulic actuator. By coordinating the fluid flow to and from each hydraulic actuator, the overall motion of the work implement linkage and the ground engaging tool may be controlled.

An operator may control the motion of the ground engaging tool on the work machine to excavate earth from a geographic location to achieve the desired surface configuration, which may be, for example, a surface having a certain slope or a trench having a certain length, width, and depth. In many cases, a substantial amount of earth, or other material, must be excavated to achieve the desired surface configuration. The operator may have to make several measurements of the current elevation of the surface of the geographic location to determine when the proper amount of material has been excavated and the desired surface configuration achieved.

To reduce the amount of measuring required, a work machine may include a positioning system that indicates the position of the ground engaging tool relative to the work machine. For example, a series of position sensors may be engaged with the ground engaging tool or the work implement linkage. Based on information provided by the sensors, a control system may determine the position of the ground engaging tool relative to the work machine. This positional information may be provided to the operator, who may use the information to estimate the current surface location of the area being excavated. In this manner, the positioning system may reduce the amount of measuring time required during an excavation procedure.

A work machine may also include a display system to provide the positional information to an operator in a graphical format. For example, as shown in U.S. Pat. No. 6,453,227 to Kalafut et al., a work machine may include a display system that is configured to show the location of the ground engaging tool relative to the body of the work machine and the work site. As the display system indicates the position of the ground engaging tool relative to the work machine, the operator may use the display system to estimate the current elevation of the surface of the geographic location.

However, the positional information provided by this type of display system may be insufficient to allow the operator to efficiently excavate a geographic location. For example, this type of display system does not indicate the location of the ground engaging tool relative to the desired surface configuration. In addition, this type of display system does not indicate the current surface level of the current geographic location relative to the desired surface configuration.

The display system of the present disclosure solves one or more of the problems set forth above.

SUMMARY OF THE INVENTION

One aspect of the present disclosure is directed to a method of displaying positional information for a work machine. A terrain map indicative of a current surface configuration for a geographic location is displayed. The display of the terrain map includes a plurality of elevation segments. Each of the plurality of elevation segments has an actual surface elevation value for a discrete area of the geographic location. A position of a ground engaging tool operatively connected to the work machine is monitored. A current elevation of the ground engaging tool is identified. The display of the elevation segment corresponding to the location of the ground engaging tool is updated when the current elevation of the ground engaging tool indicates a change in the actual surface elevation value for the elevation segment corresponding to the location of the ground engaging tool.

Another aspect of the present disclosure is directed to a display system for a work machine having a ground engaging tool. A position sensing system provides an indication of a current position of the ground engaging tool. A display device displays a terrain map indicative of a current surface configuration for a geographic location. The display of the terrain map includes a plurality of elevation segments, each of which has an actual surface elevation value for a discrete area of the geographic location. A control determines a current elevation of the ground engaging tool. The control updates the display of the elevation segment corresponding to the location of the ground engaging tool when the current elevation of the ground engaging tool indicates a change in the actual surface elevation value for the elevation segment corresponding to the location of the ground engaging tool.

DETAILED DESCRIPTION

Figure 1:
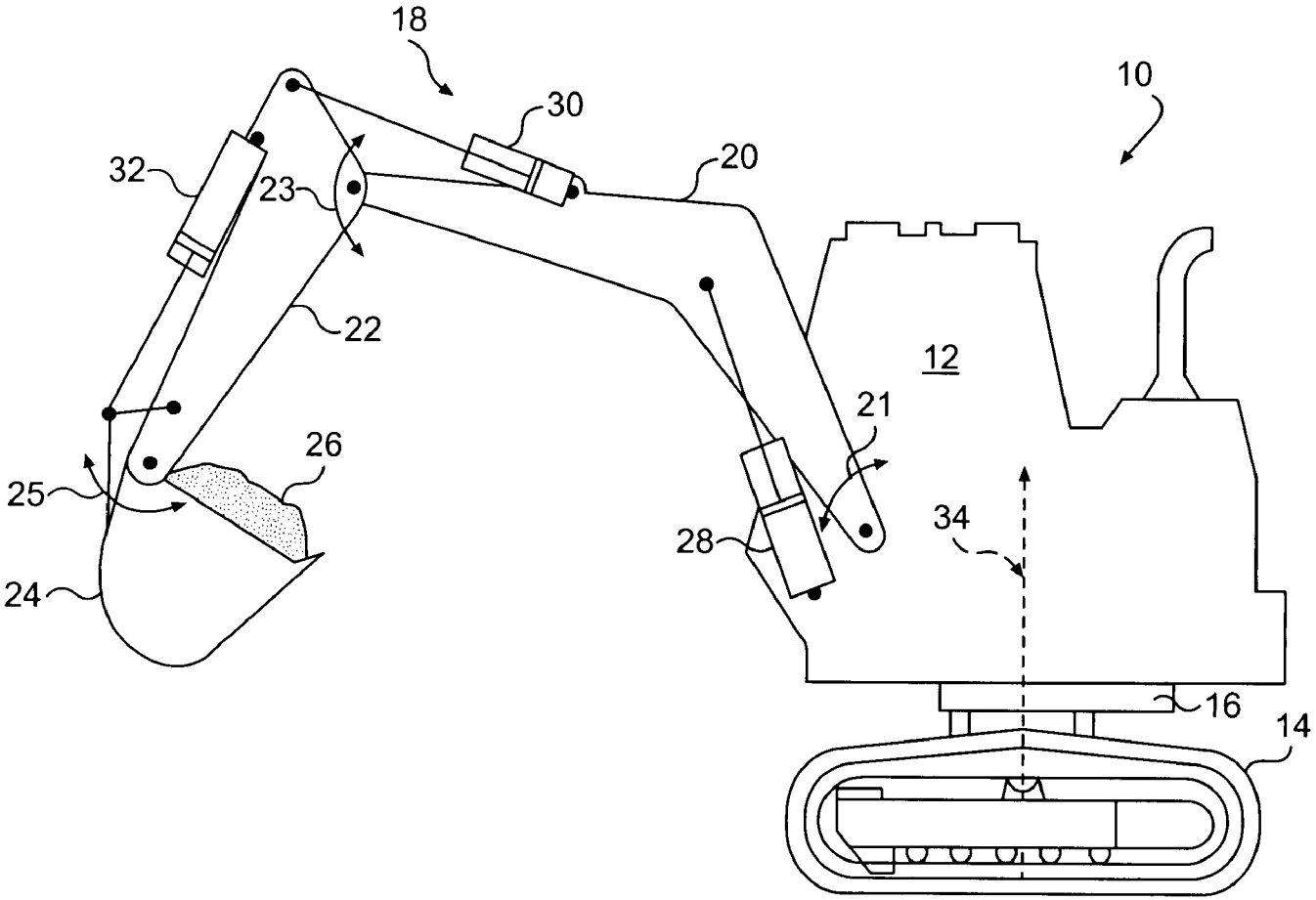
FIG. 1 is a pictorial side view of an exemplary work machine in accordance with the present invention.

An exemplary embodiment of a work machine 10 is illustrated in FIG. 1. Work machine 10 may be any type of machine commonly used to excavate earth, or other material, from a geographic location, such as, for example, an excavator or a backhoe. For the purposes of the present disclosure, the term "geographic location" is intended to include any land feature or terrain that may be excavated to shape the surface of the terrain to conform to a desired surface configuration. For example, work machine 10 may be used to excavate material from a construction site or mining site.

As illustrated in FIG. 1, work machine 10 includes a housing 12 that may include a seating area for an operator. Housing 12 may be mounted on a swing assembly 16 that is configured to rotate or pivot housing 12 about a vertical axis 34. Swing assembly 16 may include a hydraulic actuator, such as, for example, a fluid motor or a hydraulic cylinder, that pivots housing 12 about vertical axis 34. Pressurized fluid may be introduced to the hydraulic actuator of swing assembly 16 to move swing assembly 16. The direction and rate of the introduced flow of pressurized fluid governs the direction and velocity of movement of swing assembly 16.

Housing 12 and swing assembly 16 are supported by a traction device 14. Traction device 14 may be any type of device that is capable of providing a stable support for work machine 10 when work machine 10 is in operation. In addition, traction device 14 may provide for movement of work machine 10 around a job site and/or between job sites. For example, traction device 14 may be a wheel base or a track base. In addition, traction device may be a water-based vessel such as, for example, a barge.

As further illustrated in FIG. 1, work machine 10 includes a work implement linkage 18 that operatively mounts a ground engaging tool 24. Work implement linkage 18 may include a boom 20 that operatively mounts a stick 22. Stick 22 may operatively mount ground engaging tool 24. Ground engaging tool 24 may be any type of mechanism commonly used on a work machine to move earth, debris, or other material, such as load 26. For example, ground engaging tool 24 may be a shovel, a bucket, a blade, or a clamshell.

Boom 20 of the crowd mechanism may be pivotally mounted on housing 12 for movement in the directions indicated by arrow 21. In another exemplary embodiment, boom 20 may be mounted directly on swing assembly 16 and housing 12 may be fixed relative to traction device 14. In this alternative embodiment, swing assembly 16 would allow boom 20 to pivot about a vertical axis relative to housing 12.

A boom actuator 28 may be connected between boom 20 and housing 12 or between boom 20 and swing assembly 16. Boom actuator 28 may be one or more hydraulically powered actuators, such as, for example, fluid motors or hydraulic cylinders. Alternatively, boom actuator 28 may be any other device readily apparent to one skilled in the art as capable of moving boom 20 relative to housing 12. Pressurized fluid may be introduced to boom actuator 28 to move boom 20 relative to housing 12. The direction and rate of the pressurized fluid flow to boom actuator 28 may be controlled to thereby control the direction and speed of movement of boom 20.

Stick 22 is pivotally connected to one end of boom 20 for movement in the directions indicated by arrow 23. A stick actuator 30 may be connected between stick 22 and boom 20. Stick actuator 30 may be one or more hydraulically powered actuators, such as, for example, fluid motors or hydraulic cylinders. Alternatively, stick actuator 22 may be any other device readily apparent to one skilled in the art as capable of moving stick 22 relative to boom 20. Pressurized fluid may be introduced to stick actuator 30 to move stick 22 relative to boom 20. The direction and rate of the pressurized fluid flow to stick actuator 30 may be controlled to thereby control the direction and speed of movement of stick 22.

Ground engaging tool 24 is pivotally connected to one end of stick 22 for movement in the directions indicated by arrow 25. A tool actuator 32 may be connected between ground engaging tool 24 and stick 22. Tool actuator 32 may be one or more hydraulically powered actuators, such as, for example, fluid motors or hydraulic cylinders. Alternatively, tool actuator 32 may be any other appropriate device readily apparent to one skilled in the art as capable of moving ground engaging tool 24 relative to stick 22. Pressurized fluid may be introduced to tool actuator 22 to move ground engaging tool 24 relative to stick 22. The direction and rate of the pressurized fluid flow to tool actuator 32 may be controlled to thereby control the direction and speed of movement of ground engaging tool 24 relative to stick 22.

Figure 2:
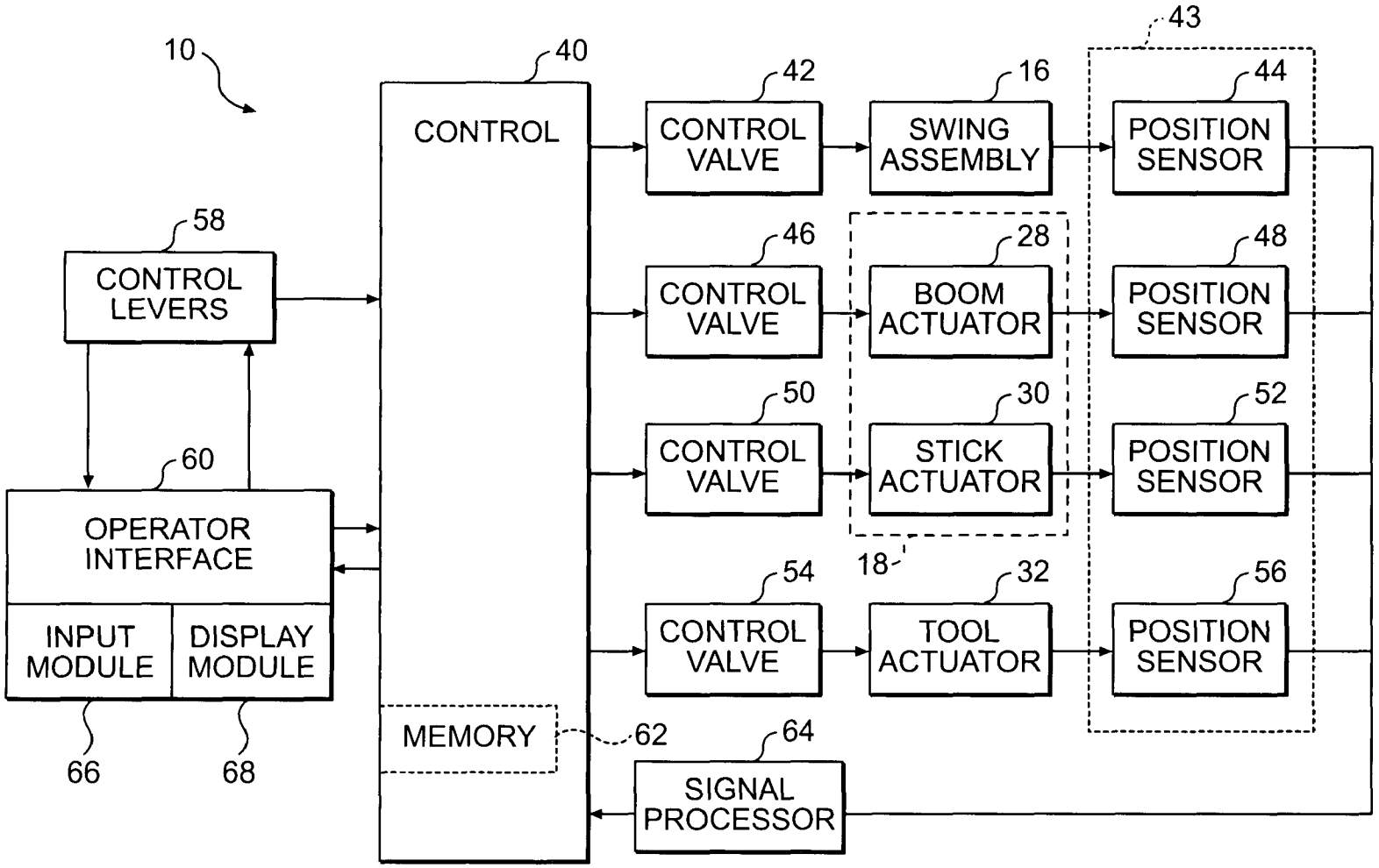
FIG. 2 is a block diagram of an exemplary embodiment of a work machine in accordance with the present invention.

As diagrammatically illustrated in FIG. 2, work machine 10 may include a control 40. Control 40 may include a computer, which has all the components required to run an application, such as, for example, a memory 62, a secondary storage device, a processor, such as a central processing unit, and an input device. One skilled in the art will appreciate that this computer can contain additional or different components. Furthermore, although aspects of the present invention are described as being stored in memory, one skilled in the art will appreciate that these aspects can also be stored on or read from other types of computer program products or computer-readable media, such as computer chips and secondary storage devices, including hard disks, floppy disks, CD-ROM, or other forms of RAM or ROM.

As further illustrated in FIG. 2, control 40 is operatively connected to a series of control valves 42, 46, 50, and 54. Control valve 42 is disposed in a fluid line leading to swing assembly 16. Control valve 46 is disposed in a fluid line leading to boom actuator 28. Control valve 50 is disposed in a fluid line leading to stick actuator 30. Control valve 54 is disposed in a fluid line leading to tool actuator 32.

Each control valve 42, 46, 50, and 54 is configured to control the rate and direction of fluid flow to the chambers of a hydraulic actuator. For example, control valve 42 controls the rate and direction of the fluid flow to the hydraulic actuator of swing assembly 16. Similarly, control valves 46, 50, and 54 control the rate and direction of fluid flow to boom actuator 28, stick actuator 30, and tool actuator 32, respectively. Each control valve 42, 46, 50, and 54 may be, for example, a directional control valve such as a set of four independent metering valves. Alternatively, each control valve 42, 46, 50 and 54 may be a spool valve, a split-spool valve, or any other mechanism configured to control the rate and direction of a fluid flow into and out of a hydraulic actuator.

Control 40 is configured to control the relative positions of control valves 42, 46, 50, and 54 to thereby control the rate and direction of fluid flow to the respective hydraulic actuators. By controlling the rate and direction of fluid flow through control valves 42, 46, 50, and 54, control 40 may control the rate and direction of movement of swing assembly 16, boom 20, stick 22, and ground engaging tool 24. In this manner, control 40 may control the overall rate and direction of movement of work implement linkage 18.

As illustrated in FIG. 2, work machine 10 may also include a position sensing system 43 that provides information on the position of work implement linkage 18 and ground engaging tool 24. Position sensing system 43 may include a series of sensors 44, 48, 52, and 56 that are adapted to sense the position of work implement linkage 18 and ground engaging tool 24. The series of sensors may be any type of sensor commonly used to determine the relative positions of the elements of a mechanical linkage.

In one exemplary embodiment, position sensors 44, 48, 52, and 56 may be adapted to determine the relative positions of each element in work implement linkage 18 supporting ground engaging tool 24. In particular, position sensor 44 may be adapted to measure the angle of rotation of swing assembly 16 relative to vertical axis 34; position sensor 48 may be adapted to measure the angle between housing 12 and boom 20; position sensor 52 may be adapted to measure the angle of rotation between boom 20 and stick 22; and position sensor 54 may be adapted to measure the angle of rotation between stick 22 and ground engaging tool 24. From this information, control 40 may determine the location of ground engaging tool 24 relative to housing 12.

Alternatively, position sensors 44, 48, 52, and 56 may be adapted to determine the relative displacement of the respective actuator, i.e. to determine the distance that the actuator is extended. In particular, position sensor 44 may be adapted to measure the extension of the hydraulic actuator associated with swing assembly 16; position sensor 48 may be adapted to measure the extension of boom actuator 28; position sensor 52 may be adapted to measure the extension of stick actuator 30; and position sensor 54 may be adapted to measure the extension of tool actuator 32. From this information, control 40 may also determine the location of ground engaging tool 24 relative to housing 12.

As will be apparent to one skilled in the art, by knowing the displacement of the actuators, the position of boom 20, stick 22, and ground engaging tool 24 relative to housing 12 may be determined through straightforward trigonometric calculations. Position sensing system 43 transmits this positional information to control 40. A signal processor 64 may be included to condition the position signals. Thus, position sensing system 43 provides the information required for control 40 to calculate the current position of ground engaging tool 24. Control 40 may use the positional information to determine the velocity, direction, and acceleration rate of ground engaging tool 24.

Control 40 may also determine the position of work machine 10 and/or ground engaging tool 24 relative to the particular surface configuration. Work machine 10 may include a global positioning system (GPS), or other location determining mechanism, that provides an indication of the position of the work machine relative to the surface configuration. Alternatively, the global positioning system may be connected with ground engaging tool 24 to provide an indication of the position of ground engaging tool 24 relative to the particular surface configuration.

Control 40 may receive movement instructions from an operator and/or an automated control program. For example, an operator may manipulate an input device consisting of a set of control levers 58 to provide the movement instructions. The set of control levers 58 may include, for example, one lever to control the motion of each of swing assembly 16, boom 20, stick 22, and ground engaging tool 24. By selectively moving the set of control levers 58, an operator may individually and selectively control the rate and direction of movement of each of swing assembly 16, boom 20, stick 22, and ground engaging tool 24. Thus, by coordinating movement of control levers 58, the operator may control motion of work implement linkage 18. Alternatively, control 40 may include an automated program that provides movement instructions for work implement linkage 18 and ground engaging tool 24 to guide ground engaging tool 18 throughout an entire work cycle.

Work machine 10 may also include an operator interface 60. Operator interface 60 may include an input module 66 and a display module 68 that provide an interface between an operator and control 40. Input module 66 may allow the operator to input information to control 40, whereas display module 68 may present information from control 40 to the operator.

Input module 66 may include an input device, such as, for example, a touch screen, a keyboard, a mouse, or a joystick. An operator may input information through input module 66 to control 40 related to a particular job. This information may include a desired surface configuration for a particular geographic location. For example, the operator may identify certain configuration parameters for a trench to be excavated in the particular geographic location. The configuration parameters may include, for example, length, width, and depth measurements for the trench. Alternatively, the operator may desire to specify a certain slope angle for the particular geographic location. The desired slope angle configuration may be a level surface, an inclining surface, or a declining surface. It is contemplated that the desired surface configuration parameters may be entered as distance and angle measurements relative to the position of work machine 12. Alternatively, the desired surface configuration parameters may be entered as absolute distance and angle measurements, such as may be determined through a global positioning system.

Input module 66 may be used to input other instructions to control 40. For example, an operator may instruct control 40 to follow a certain automated work cycle. Input module 66 may also be used to input any other information required by control 40.

Display module 68 may be adapted to provide information to the operator regarding the operation of work machine 12. For example, display module 68 may graphically or pictorially display information regarding the position of ground engaging tool 24. Display module 68 may also be used to display any other information required or desired by the operator.

Figure 3:
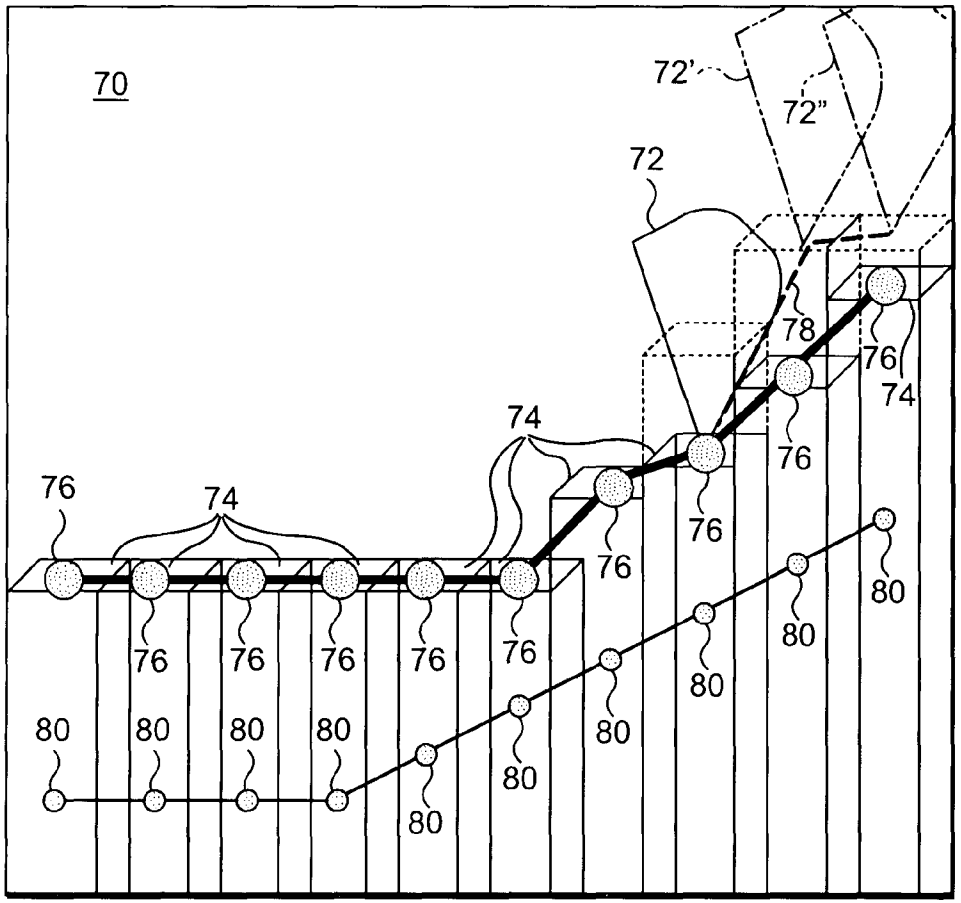
FIG. 3 is a pictorial representation of a display in accordance with an exemplary embodiment of the present invention.

An exemplary display of a terrain map 70 provided by display module 68 is illustrated in FIG. 3. The terrain map display may also include a tool representation 72 that provides an indication of the current position of ground engaging tool 24. It is contemplated that the display may also include one or more previous tool representations 72' and 72" that indicate previous positions of ground engaging tool 24. The display may also provide an indication of a movement path 78 of the tip, or other portion, of ground engaging tool 24.

The display of terrain map 70 may be divided into a series of elevation segments 74. Each of elevation segments 74 may represent a discrete area of the particular geographic location to be excavated. Control 40 may maintain a three-dimensional array of elevation segments 74 corresponding to discrete areas of the portion of the particular geographic location that are within the reach of ground engaging tool 24. Control 40 may display the series of elevation segments 74 that correspond to the current location of ground engaging tool 24. For example, control 40 may display those elevation segments 74 that align with the current operating plane of work implement linkage 18.

Memory 62 of control 40 may store two values for each elevation segment 74. Memory 62 may store a desired surface elevation value 80 and an actual surface elevation value 76. The series of desired surface elevation values 80 may be entered by the operator through input module 66 of operator interface 60.

Figure 4:
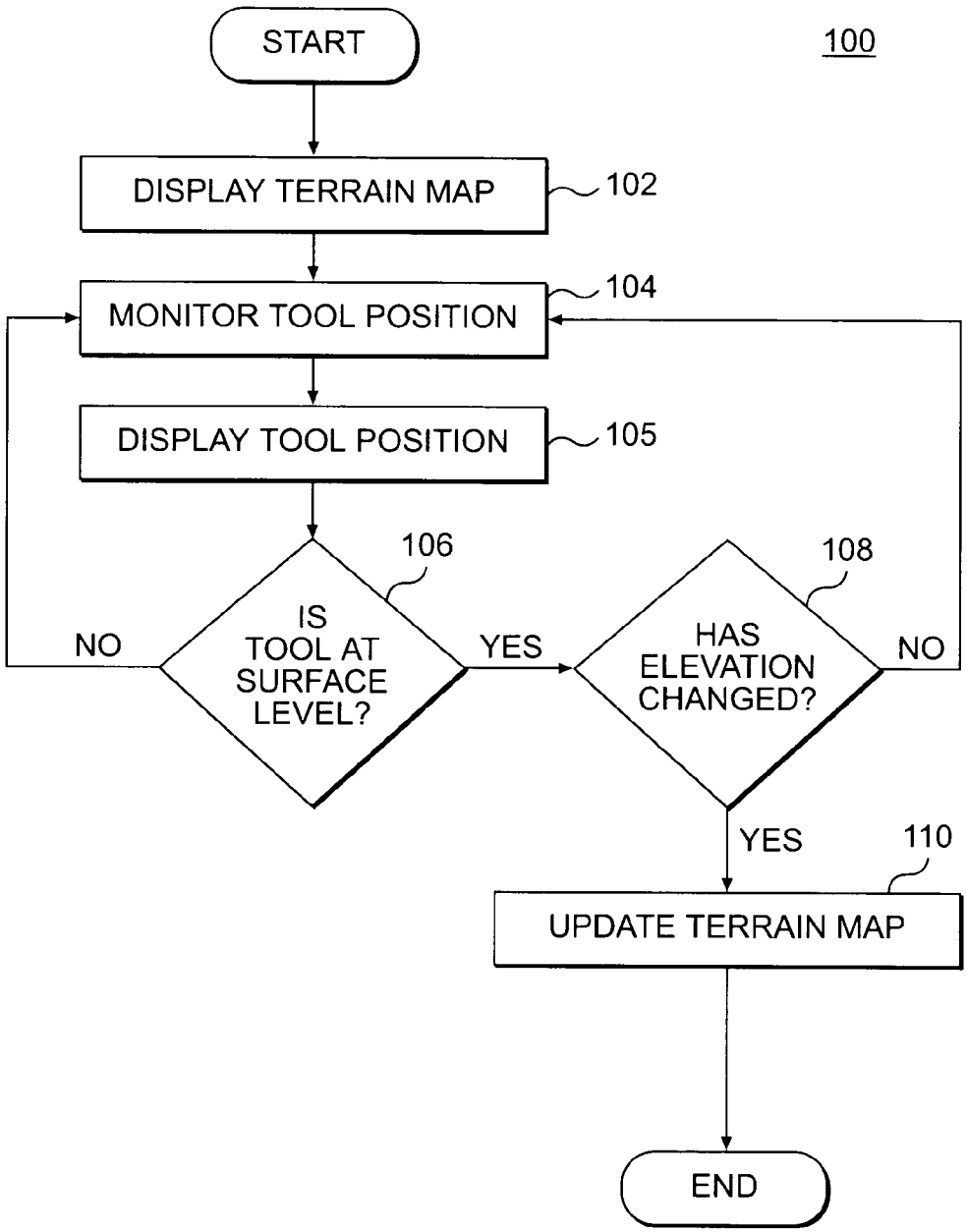
FIG. 4 is a flowchart illustrating an exemplary method of displaying information to an operator in accordance with the present invention.

Control 40 may update actual surface elevation values 76 during the operation of work machine 10. Control 40 may update the actual surface elevation value 76 for a particular elevation segment 74 when control 40 determines that ground engaging tool 24 is engaged with the surface of the geographic location. Control 40 may determine that ground engaging tool 24 is engaged with the surface of the geographic location through a variety of methods, such as, for example, when one of actuators 28, 30, or 32 experience an increased force, or when ground engaging tool 24 is moved to a lower elevation than the previous value of the corresponding actual surface elevation value 76. An exemplary method 100 of displaying and updating positional information to the operator of work machine 10 is illustrated in FIG. 4 and is described in greater detail below.

INDUSTRIAL APPLICABILITY

An operator may operate work machine 10 to excavate earth or other material from a particular geographic location. The operator may input a desired surface configuration for the particular geographic location through operator interface 60. The desired surface configuration may be stored in memory 62 of control 40 as a series of desired surface elevation values 80. Each desired surface elevation value 80 may correspond to an elevation segment 74 that represents a discrete area of the particular geographic location.

Display module 68 may display terrain map 70 to the operator. (Step 102) The display of terrain map 70 may include a representation of the desired surface elevation value 80 for a series of elevation segments 74. The display of terrain map 70 may also include a representation of the actual surface elevation value 76 for the series of elevation segments 74.

The position of ground engaging tool 24 is monitored. (Step 104). Position sensing system 43 may determine the position of ground engaging tool 24. The position of ground engaging tool 24 may be measured relative to housing 12 of work machine 10 or relative to any other fixed position.

Display module 68 may display a representation of the current position of ground engaging tool 24 relative to elevation segments 74. (Step 105). The position of ground engaging tool 24 may be displayed relative to the elevation values for both the actual surface level 76 and the desired surface level 80. In this manner, the operator may quickly determine the amount of material to be removed to achieve the desired surface configuration.

Control 40 may determine if ground engaging tool 24 is engaged with the surface of the particular geographic location. (Step 106). Control 40 may determine that ground engaging tool 24 is engaged with the surface based on information provided by position sensing system 43. If position sensing system 43 indicates that ground engaging tool 24 is at an elevation lower than the actual surface elevation value 76 stored in memory 62, control 40 may assume that ground engaging tool 24 has removed material from the geographic location and that the actual surface elevation value 76 should be updated accordingly.

Alternatively, control 40 may determine that ground engaging tool 24 is engaged with the surface based on information provided by pressure sensors (not shown) associated with one or more of tool actuator 32, stick actuator 30, and boom actuator 28. An increase in the pressure within one of these actuators, or in a fluid line connected with one of these actuators, may indicate that ground engaging tool 24 is engaged with the current surface level of the geographic location. When such a pressure increase is identified, control 40 may obtain the current position of ground engaging tool 24 from position sensing system 43 and modify the actual surface elevation value accordingly.

Control 40 may also determine if the actual surface elevation value 76 has changed and should be updated. (Step 108). If control 40 determines that the elevation at which ground engaging tool 24 has engaged the current surface of the geographic location is different than the elevation value stored in memory 62, control 40 may update the actual surface elevation value 76 accordingly. The actual surface elevation value 76 may be decreased as material is removed from the geographic location. The actual surface elevation value 76 may be increased, or reset, when the operator "backfills," or adds material to a previously excavated area.

If the actual surface elevation value 76 is updated, the display of terrain map 70 may also be updated to reflect the change in elevation. (Step 110). By updating the display of terrain map 70, control 40 may provide information to the operator regarding the location of the current surface of the geographic location with respect to the desired surface configuration. In this manner, the operator may determine the amount of material to remove to achieve the desired surface configuration.

Control 40 may continue to monitor the position of ground engaging tool 24. Control 40 may also continue to determine when ground engaging tool 24 is engaged with the current surface level of the geographic location and update the display of terrain map 70 accordingly. The updates may be performed continuously or on a periodic basis during the operation of work machine 10.

The display system described above may be used to provide positional information to the operator of a work machine. The display system may display a representation of the current position of the ground engaging tool, the current elevation of the surface of the geographic area being worked, and the elevation of the desired surface configuration. Each representation may be displayed relative to one another so that the operator may determine whether the current surface level of the geographic location is above or below the desired surface configuration and whether the ground engaging tool is above or below the desired surface configuration. In addition, the information provided by the display may allow the operator to estimate the amount of material left to be removed from the geographic location to achieve the desired surface configuration.

The above-described display system may be used with any type of work machine. For example, the display system may be used with an excavating work machine such as an excavator or backhoe. One skilled in the art will recognize, however, that the described display system may be used with other types of work machines, such as, for example, bulldozers or motor graders.

It will be apparent to those skilled in the art that various modifications and variations can be made in the described display system without departing from the scope of the invention. Other embodiments of the disclosed display system will be apparent to those skilled in the art from consideration of the specification and practice of the display system disclosed herein. It is intended that the specification and examples be considered as exemplary only, with a true scope being indicated by the following claims and their equivalents.

What is claimed is:

1. A method of displaying positional information for a work machine, comprising:

displaying a terrain map indicative of a current surface configuration for a geographic location, the display of the terrain map including a plurality of elevation segments, each of the plurality of elevation segments having an actual surface elevation value indicative of the current surface configuration for a discrete area of the geographic location;

monitoring a position of a ground engaging tool operatively connected to the work machine;

identifying a current elevation of the ground engaging tool; and updating the display of the elevation segment corresponding to the location of the ground engaging tool when the current elevation of the ground engaging tool indicates a change in the actual surface elevation value for the elevation segment corresponding to the location of the ground engaging tool.

2. The method of claim 1, further including updating the display of the elevation segment corresponding to the location of the ground engaging tool when the current elevation of the ground engaging tool is less than the actual surface elevation value for the elevation segment corresponding to the location of the ground engaging tool.

3. The method of claim 1, further including:

identifying a desired surface configuration for the geographic location; and displaying a representation of the desired surface configuration.

4. The method of claim 3, further including displaying a representation of the current position of the ground engaging tool relative to the desired surface configuration.

5. The method of claim 1, further including updating the display of the elevation segment corresponding to the location of the ground engaging tool when a sensor operatively associated with the ground engaging tool indicates that the ground engaging tool is engaged with the surface level of the geographic location.

6. The method of claim 1, further including resetting the actual surface elevation value for at least one of the plurality of elevation segments when the corresponding discrete area of the geographic location is backfilled.

7. The method of claim 1, wherein the terrain map represents a portion of the geographic location within a reach of the ground engaging tool.

8. A display system for a work machine having a ground engaging tool, comprising:

a position sensing system adapted to provide an indication of a current position of the ground engaging tool;

a display device adapted to display a terrain map indicative of a current surface configuration for a geographic location, the display of the terrain map including a plurality of elevation segments, each of the plurality of elevation segments having an actual surface elevation value indicative of the current surface configuration for a discrete area of the geographic location; and a control operable to determine a current elevation of the ground engaging tool and to update the display of the elevation segment corresponding to the location of the ground engaging tool when the current elevation of the ground engaging tool indicates a change in the actual surface elevation value for the elevation segment corresponding to the location of the ground engaging tool.

9. The display system of claim 8, wherein the control includes a memory adapted to store a desired surface configuration for the geographic location.

10. The display system of claim 9, wherein the display device displays a representation of the desired surface configuration.

11. The display system of claim 10, wherein the display device displays a representation of the current position of the ground engaging device relative to the desired surface configuration.

12. The display system of claim 8, wherein the position sensing system includes a series of sensors operatively connected to the ground engaging tool.

13. The display system of claim 8, wherein the control is further adapted to reset the actual surface elevation value for one of the plurality of elevation segments when the corresponding discrete area of the geographic location is backfilled.

14. A work machine, comprising:

a traction device;

a housing mounted on the traction device;

a ground engaging tool;

a position sensing system operatively connected to the ground engaging tool and adapted to provide an indication of a current position of the ground engaging tool;

a display device adapted to display a terrain map indicative of a current surface configuration for a geographic location, the display of the terrain map including a plurality of elevation segments, each of the plurality of elevation segments having an actual surface elevation value indicative of the current surface configuration for a discrete area of the geographic location; and a control operable to determine a current elevation of the ground engaging tool and to update the display of the elevation segment corresponding to the location of the ground engaging tool when the current elevation of the ground engaging tool indicates a change in the actual surface elevation value for the elevation segment corresponding to the location of the ground engaging tool.

15. The work machine of claim 14, wherein the control includes a memory adapted to store a desired surface configuration for the geographic location.

16. The work machine of claim 15, wherein the display device displays a representation of the desired surface configuration.

17. The work machine of claim 16, wherein the display device displays a representation of the current position of the ground engaging device relative to the desired surface configuration.

18. The work machine of claim 14, wherein the control is further adapted to reset the actual surface elevation value for one of the plurality of elevation segments when the corresponding discrete area of the geographic location is backfilled.

19. The work machine of claim 14, further including a work implement linkage operatively supporting the ground engaging tool.

20. The work machine of claim 19, further including a swing assembly configured to pivot the work implement linkage relative to a vertical axis and wherein the work implement linkage includes, a stick operatively mounting the ground engaging tool, and a boom operatively supporting the stick, and wherein the position sensing system includes at least one sensor operatively connected to the ground engaging tool, the stick, the boom, and the swing assembly.

21. A display system for a work machine including a ground engaging tool, comprising:

a sensing means for sensing a current position of the ground engaging tool;

a display means for displaying a terrain map indicative of a current surface configuration for a geographic location, the display of the terrain map including a plurality of elevation segments, each of the plurality of elevation segments having an actual surface elevation value indicative of the current surface configuration for a discrete area of the geographic location; and a control means for determining a current elevation of the ground engaging tool when the ground engaging tool is positioned at a surface level of the geographic location and for updating the display of the elevation segment corresponding to the location of the ground engaging tool when the current elevation of the ground engaging tool indicates a change in the actual surface elevation value for the elevation segment corresponding to the location of the ground engaging tool.

* * * * *